United States Patent [19]

Bruce

[11] 3,959,863

[45] June 1, 1976

[54] MANUFACTURE OF AGRICULTURAL DISCS

[76] Inventor: Walter Esmond Bruce, Crown Steel Works, Sheffield, England

[22] Filed: Jan. 22, 1974

[21] Appl. No.: 435,539

[52] U.S. Cl. ..... 29/148.3; 72/336; 72/340; 172/604

[51] Int. Cl.[2] ..... B21K 19/00

[58] Field of Search ..... 172/604; 72/336, 337, 72/338, 340; 148/12.4, 31; 29/DIG. 17, DIG. 32, 148.3

[56] References Cited

UNITED STATES PATENTS

| | | | |
|---|---|---|---|
| 488,514 | 12/1892 | Arnold | 172/604 |
| 691,565 | 1/1902 | Norton | 29/DIG. 17 |
| 1,007,399 | 10/1911 | Spalding | 172/604 |
| 1,924,099 | 8/1933 | Bain et al. | 148/31 |
| 2,154,534 | 4/1939 | Schuster | 29/DIG. 32 |
| 2,395,184 | 2/1946 | Hume et al. | 148/12.4 |
| 2,416,742 | 3/1947 | Farr | 172/604 |
| 2,814,580 | 11/1957 | Hoover | 172/604 |

*Primary Examiner*—C. W. Lanham
*Assistant Examiner*—James R. Duzan
*Attorney, Agent, or Firm*—Lowe, King, Price & Markva

[57] ABSTRACT

In order to overcome the limitations on availability of suitable steel strip or bars in widths to suit all diameters of agricultural discs, a method of manufacturing such discs comprises cutting blanks from rolled steel strip or bar having a thickness greater than the thickness of the finished discs and a width less than the diameter of the finished disc, the blanks having a length substantially equal to the diameter of the finished discs, rolling each blank in the direction of its width until that dimension has increased to not less than the diameter of the finished discs, and blanking out from each rolled blank a disc with a diameter not less than the diameter of the finished discs and with a central hole, the cross-rolling of the strip or bar necessary to achieve the required increase in width and reduction in thickness having the beneficial result in affording quality comparable with that of discs formed from cross-rolled plate or sheet.

8 Claims, 5 Drawing Figures

10
12
13
W
L
14
16
24
25
III
VII
23
13B
22
21
W1
19
17
13A
18
20
15
II

MANUFACTURE OF AGRICULTURAL DISCS

This invention relates to the manufacture of agricultural discs and is particularly concerned with the economical production of agricultural discs of high quality from rolled steel strip or bar in place of cross-rolled plate or sheet.

According to the present invention, a method of manufacturing agricultural discs comprises cutting blanks from rolled steel strip or bar having a thickness greater than the thickness of the finished discs and a width less than the diameter of the finished discs, the blanks having a length substantially equal to the diameter of the finished discs, rolling each blank in the direction of its width until that dimension has increased to not less than the diameter of the finished discs, and blanking out from each rolled blank a disc with a diameter not less than the diameter of the finished discs and with a central hole. The edge of each blanked-out disc may be sharpened by any of the usual methods, e.g., rolling and/or swaging and/or grinding.

The benefit afforded by the invention is two-fold in that it overcomes limitations on availability of suitable steel strip of bar in widths to suit all diameters of discs, and in that the cross-rolling of the strip or bar necessary to achieve the required increase in width and reduction in thickness results in quality comparable with that of discs formed from cross-rolled plate or sheet.

There being no appreciable limitations on the thickness of suitable rolled steel strip or bar, the diameter of discs produced from a standard (e.g., limiting) width of strip or bar can be increased by increasing the thickness of the strip or bar, increasing the length of each cut blank, and increasing the reduction in thickness effected by cross-rolling, with accompanying increase in the width to equal the length, or substantially so.

The cut blanks are preferably heated before rolling, especially if a particularly heavy reduction in thickness and increase in width is necessary, and allowed to remain hot through the blanking operation. Each blank may be rolled more than once, especially if a particularly heavy reduction in thickness and increase in width is necessary.

The blanking operation may be carried out in two stages, the first stage being to punch the central hole with reference to two adjacent sides of each rolled blank, and the second stage being to punch out the disc with reference to the central hole.

The blanking operation, or the second stage of it, may include dishing of the discs, and may be followed by quenching, after which the edges of the discs are sharpened.

A preferred method in accordance with the invention will now be described, by way of example only, with reference to the accompanying drawings, in which.

Figure 1:
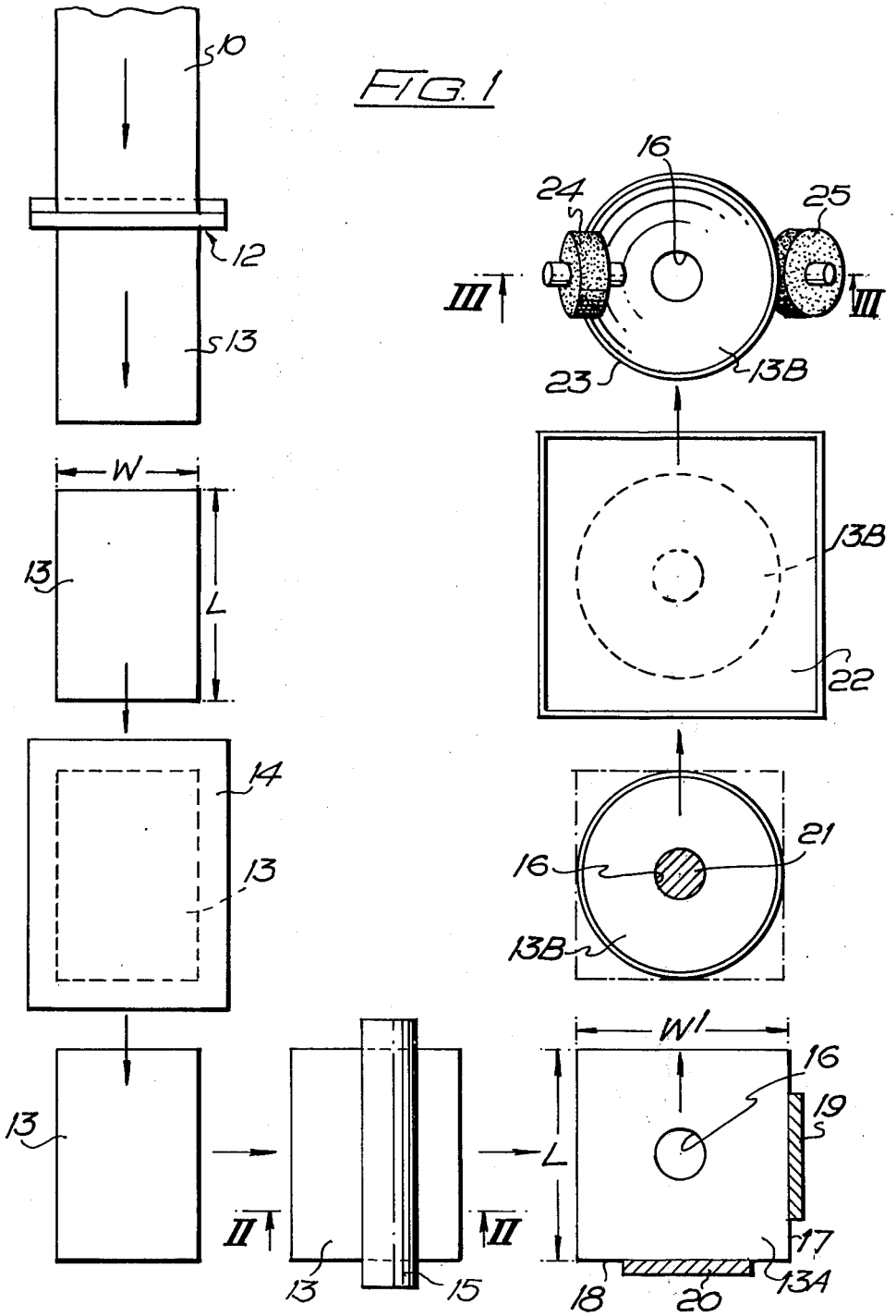
FIG. 1 is a diagrammatic plan of the steps of the preferred method.
Figure 2:
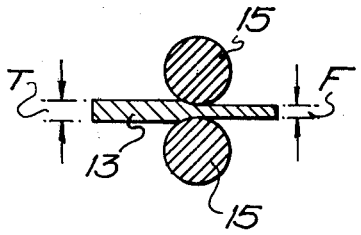
FIGS. 2 and 3 are diagrammatic sections on the lines II—II and III—III respectively of FIG. 1.
Figure 3:
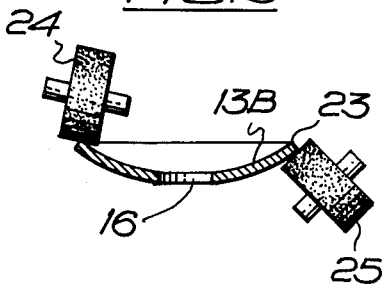
Figure 4:
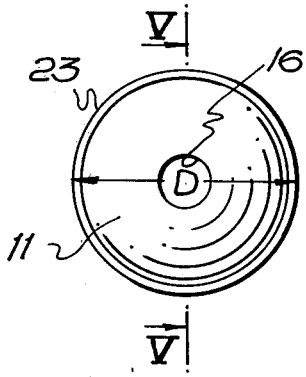
FIG. 4 is an elevation of a finished disc manufactured by the preferred method.
Figure 5:
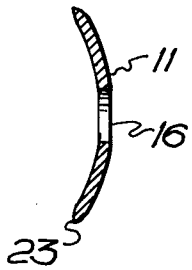
FIG. 5 is a section on the line V—V of FIG. 4.

Starting at the top left hand corner, FIG. 1 shows rolled steel strip or bar 10 having a thickness T greater than the thickness E of the finished discs (see FIG. 2) and a width W less than the diameter D of the finished discs 11 (see FIGS. 4 and 5) being cut by a guillotine 12 to form blanks 13 which pass through a furnace 14 to heat them before rolling between rolls 15 (bottom centre and FIG. 2). The blanks have a length L substantially equal to the diameter D of the finished discs and are rolled in the direction of their width until that dimension has increased to W′ which is not less than the diameter of the finished discs. The rolled blanks 13A are blanked out in two stages, the first stage being to punch out the central hole 16 with reference to two adjacent sides 17, 18 of each rolled blank which is located against stops 19, 20 respectively in a press, and the second stage being to punch out the disc 13B with reference to the central hole 16 which is located on a spigot 21 in a press. The second stage of the blanking operation includes dishing of the discs 13B, and is followed by quenching in a vat 22, after which the edges 23 of the discs are sharpened by grinding wheels 24, 25 inside and outside respectively with respect to the dished discs.

Steel strip or bar 10 is more readily available than cross-rolled plate or sheet of the required thickness F and width W′ to suit all diameters of discs, but the invention also affords great benefit in that the cross-rolling of the strip or bar necessary to achieve the required increase in width and reduction in thickness results in quality comparable with that of discs formed from cross-rolled plate or sheet, and at far less overall cost.

What I claim is:

1. A method of manufacturing agricultural discs from rolled steel strip having a thickness greater than the thickness of the finished discs and a width less than the diameter of the finished discs, comprising the steps of cutting blanks having a length substantially equal to the diameter of the finished discs, said blanks having a width less than the diameter of the finished discs, heating the blanks, rolling each blank only in the direction of its width until that dimension has increased to not less than the diameter of the finished discs, and blanking out from each rolled blank a disc with a diameter not less than the diameter of the finished discs and with a central hole.

2. A method as in claim 1, wherein the blanks are allowed to remain hot through the blanking operation.

3. A method as in claim 2, wherein the blanked out discs are quenched.

4. A method as in claim 1, wherein the blanking operation is carried out in two stages, the first stage being to punch the central hole with reference to two adjacent sides of each rolled blank, and the second stage being to punch out the disc with reference to the central hole.

5. A method as in claim 1, wherein the blanking operation includes dishing of the discs.

6. A method as in claim 4, wherein the second stage of the blanking operation includes dishing of the discs.

7. A method of manufacturing an agricultural disc from rolled steel strip having a thickness greater than the thickness of a finished disc and a width less than the diameter of the finished disc comprising the steps of:

cutting a blank having a length substantially equal to the diameter of the finished disc, said blank having a width less than the diameter of the finished disc;

heating the blank;

rolling said heated blank in the direction of its width until that dimension has increased to at least the diameter of the finished disc;

blanking out from the rolled heated blank, a disc with a diameter at least that of the finished disc and with a central hole; and quenching out the blanked heated disc.

8. A method of manufacturing an agricultural disc from rolled steel strip having a thickness greater than the thickness of a finished disc and a width greater than the diameter of the finished disc comprising the steps of:

cutting a blank having a length substantially equal to the diameter of the finished disc, said blank having a width less than the diameter of the finished disc;

heating the blank;

rolling the heated blank in the direction of its width until that direction has increased to at least the diameter of the finished disc;

blanking out from the rolled heated blank a disc with a diameter not less than the diameter of the finished disc, wherein the step of blanking includes the steps of punching out a central hole with reference to two adjacent sides of each rolled blank, and punching out the disc with reference to the central hole;

dishing the disc; and quenching the blanked out disc.

* * * * *